US010300595B1

(12) United States Patent
Fletcher

(10) Patent No.: US 10,300,595 B1
(45) Date of Patent: May 28, 2019

(54) SOCKET HOLDER AND STORAGE DEVICE

(71) Applicant: Anthony Fletcher, Jacksonville, FL (US)

(72) Inventor: Anthony Fletcher, Jacksonville, FL (US)

( * ) Notice: Subject to any disclaimer, the term of this patent is extended or adjusted under 35 U.S.C. 154(b) by 395 days.

(21) Appl. No.: 15/201,338

(22) Filed: Jul. 1, 2016

Related U.S. Application Data

(60) Provisional application No. 62/187,288, filed on Jul. 1, 2015.

(51) Int. Cl.
*B25H 3/00* (2006.01)
*B25H 3/04* (2006.01)
*B65D 73/00* (2006.01)

(52) U.S. Cl.
CPC ..... *B25H 3/04* (2013.01); *B25H 3/003* (2013.01); *B65D 73/0014* (2013.01)

(58) Field of Classification Search
CPC ..... B25H 3/04; B25H 3/003; B65D 73/0014; B25B 13/56
USPC ..... 206/373, 372, 374, 375, 376, 377, 378, 206/379, 477, 480, 483, 806, 495, 775, 206/779, 493; 211/70.6, 69, 69.5
See application file for complete search history.

(56) References Cited

U.S. PATENT DOCUMENTS 470,567 A * 3/1892 Hitch ..... B65D 88/1637 383/19
2,841,289 A * 7/1958 Odlum ..... B25H 3/003 211/70.6
3,136,419 A * 6/1964 Ruderian ..... A63B 39/00 206/579
4,729,473 A * 3/1988 Kulzer ..... B65D 73/0064 206/477
5,328,029 A * 7/1994 Chow ..... B25H 3/003 206/376
5,855,274 A * 1/1999 Piao ..... B25H 3/02 206/373
6,257,409 B1 * 7/2001 Lin ..... B25H 3/04 206/376
6,631,802 B2 * 10/2003 Hsu ..... B25H 3/003 206/373
7,150,362 B1 * 12/2006 Questiaux ..... B25H 3/04 211/70.6
9,522,467 B1 * 12/2016 Kao ..... A47F 7/0028
2003/0080076 A1 * 5/2003 Hu ..... A47F 7/0028 211/70.6
2004/0016667 A1 * 1/2004 Chen ..... B25H 3/003 206/373
2005/0194332 A1 * 9/2005 Berfield ..... A47L 9/0063 211/70.6
2012/0175277 A1 * 7/2012 Hutchens ..... G09F 23/00 206/372

(Continued)

*Primary Examiner* — Jacob K Ackun
*Assistant Examiner* — Jenine Pagan
(74) *Attorney, Agent, or Firm* — Mark Young, PA

(57) ABSTRACT

A socket holder and storage device includes a sheet of plastic with tabbed cutouts. The cutouts are generally upside down U-shaped apertures with an integrally formed cantilevered tab extending upwardly from the middle of the bottom of the aperture. The tab, which can be deflected, is sized and configured to fit in the square drive recess of a socket. The aperture is sized and shaped to receive a socket and prevent disengagement from the tab unless the tab is deflected. The sheet may be equipped with various accessories and stored in crates.

16 Claims, 24 Drawing Sheets

(56) References Cited

U.S. PATENT DOCUMENTS

| | | | | |
|---|---|---|---|---|
| 2012/0305438 | A1* | 12/2012 | Kao | B25H 3/04<br>206/525 |
| 2017/0014988 | A1* | 1/2017 | Yeh | B25H 3/04 |

* cited by examiner

SOCKET HOLDER AND STORAGE DEVICE

RELATED APPLICATION

This application is a nonprovisional of and claims the benefit of priority of U.S. Provisional Application No. 62/187,288 filed Jul. 1, 2015, the entire contents of which are incorporated herein by this reference.

FIELD OF THE INVENTION

This invention relates generally to tools, and, more particularly, to a holder and storage device for sockets, socket wrenches and related accessories.

BACKGROUND

Since the advent of socket wrenches, various devices have been developed to hold and store sockets in an orderly manner. The devices include tool cases, which may contain a molded insert with recesses into which sockets are stored, racks with protruding spring clips sized to fit into the square drive recess of sockets, sleeves with walls defining a narrowing channel into which sockets of varying sizes will fit, and other similar devices. While such devices may hold sockets, they are limited in organizing sockets. A user with many sockets, may be relegated to stacking storage devices, one upon another, or searching through various drawers or compartments of a tool chest to find the correct socket. Additionally, many of the devices do not provide adequate drainage when tools are used or left in the rain. Furthermore, they do not greatly facilitate locating the correct socket. Moreover, they are unsuitable for use with readily available storage crates, such as milk crates.

The invention is directed to overcoming one or more of the problems and solving one or more of the needs as set forth above.

SUMMARY OF THE INVENTION

To solve one or more of the problems set forth above, in an exemplary implementation of the invention, a socket holder and storage device includes a sheet of plastic with one or more tabbed cutouts. The cutouts are generally upside down U-shaped apertures with an integrally formed cantilevered tab extending upwardly from the middle of the bottom of the aperture. The tab, which can be deflected, is sized and configured to fit in the square drive recess of a socket. The aperture is sized and shaped to receive a socket, with the square recess of the socket slid onto the tab. The aperture is sized and shaped to prevent disengagement from the tab unless the tab is deflected. The sheet may be equipped with various accessories including spring clips or clamps to hold wrenches, universal joints and extensions. The sheet may also be equipped with one or more handles to facilitate manipulation. The sheet may also have one or more integrally formed or attachable file organizing tabs along the top edge to indicate the tools stored on the sheet. Several sheets may be stored in crates, such as milk crates.

An exemplary tool holder according to principles of the invention includes a sheet (i.e., panel). The sheet is generally rigid and planar and has a top edge, a bottom edge, a first side edge and an opposite second side edge. A circular aperture is formed in the sheet. The circular aperture has a diameter of about 0.45 to 0.75 inches. A plurality of spaced apart socket holders are formed in the sheet spaced apart from the circular aperture. Each socket holder includes a generally upside down U-shaped opening with a width of about 0.75 to 1.5 inches and a height of about 1.5 to 2.5 inches. The U-shaped opening includes a top, a bottom, a first side and a second side. The first side and second side are parallel and spaced apart. The top and bottom are parallel and spaced apart. The U-shaped opening defines a vertical tab extending upwardly from the bottom of the U-shaped opening, between the first side and second side of the U-shaped opening, to between the top and bottom of the U-shaped opening. The vertical tab is flexible and has a tab width that is not greater than ⅕ to ⅓ of the width of the U-shaped opening, and a gap between the top of the U-shaped opening and the vertical tab is at least about 0.5 to 1.0 inches.

The plurality of spaced apart socket holders may include a first row of spaced apart socket holders. The bottom of each U-shaped opening of each socket holder in the first row of spaced apart socket holders may be in vertical alignment. The plurality of spaced apart socket holders may also include a second row of spaced apart socket holders. The bottom of each U-shaped opening of each socket holder in the second row of spaced apart socket holders is in vertical alignment and parallel to the bottom of each U-shaped opening of each socket holder in the first row of spaced apart socket holders.

A plurality of clamping devices may be attached to the sheet. Each clamping device includes a clamp mounting base and flexible clamping arm extending from the clamp mounting base. The clamp mounting base is attachable to the sheet and the clamping arm defines a clamping space between the clamping arm and the sheet. The clamping space is configured to secure a tool against the sheet. The clamping arm has a proximal end at the clamp mounting base and an opposite distal end. The clamping base includes a clamping base surface parallel to and abutting the sheet. The clamping arm extends at an acute angle relative to the sheet. Each clamping device may further include an elbow. The elbow includes an intermediate segment extending from the distal end of the clamping arm towards the sheet. The elbow further includes a terminal segment extending from the intermediate segment away from and about parallel to the clamping arm towards the sheet. The clamp mounting base includes a clamp mounting pin and a clamp mounting hole. The sheet includes a pair of clamp mounting apertures for each of the plurality of clamping devices. The pair of clamp mounting apertures includes a first clamp mounting aperture sized to receive the clamp mounting pin and a second clamp mounting aperture positioned to align with the clamp mounting hole while the clamp mounting pin is received in the first mounting aperture.

A first pair of clamp mounting apertures includes a first lower clamp mounting aperture below a first upper clamp mounting aperture. A first clamp axis (imaginary straight line) extends from the center of the first lower clamp mounting aperture to the center of the first upper clamp mounting aperture. A second pair of mounting apertures includes a second lower clamp mounting aperture below a second upper clamp mounting aperture. A second clamp axis extends from the center of the second lower clamp mounting aperture to the center of the second upper clamp mounting aperture. The first clamp axis is parallel to and spaced apart from the second clamp axis. A third clamp axis extends from the center of the first lower clamp mounting aperture to the center of the second lower clamp mounting aperture. A fourth clamp axis extends from the center of the first upper clamp mounting aperture to the center of the second upper clamp mounting aperture. The third clamp axis is perpendicular to the first clamp axis and parallel to the fourth clamp axis.

The plurality of clamping devices includes a first clamping device and a second clamping device. The tool holder further includes a plurality of wedges, including a first wedge and a second wedge. Each wedge includes a wedge base and a stopping surface. The wedge base is attachable to the sheet, and the stopping surface is about perpendicular to the wedge base. The first wedge is attached to the sheet adjacent to the first clamping device. The second wedge is attached to the sheet adjacent to the second clamping device. The wedge base includes a wedge mounting pin and a wedge mounting hole. The sheet includes a pair of wedge mounting apertures for each of the plurality of wedges. The pair of wedge mounting apertures include a first wedge mounting aperture sized to receive the wedge mounting pin and a second wedge mounting aperture positioned to align with the wedge mounting hole while the wedge mounting pin is received in the first wedge mounting aperture.

A first pair of wedge mounting apertures includes a first left wedge mounting aperture and a first right wedge mounting aperture. A first wedge axis extends from the center of the first left wedge mounting aperture to the center of the first right wedge mounting aperture. A second pair of wedge mounting apertures includes a second left wedge mounting aperture and a second right wedge mounting aperture. A second wedge axis extends from the center of the second left wedge mounting aperture to the center of the second right wedge mounting aperture. The first wedge axis is aligned with and spaced apart from the second wedge axis.

A handle aperture is formed in the sheet adjacent to the top edge. The handle aperture includes an opening of about 3 to 5 inches in width and 0.5 to 1.5 inches in height.

A pair of support tabs are provided. The support tabs include a first tab extending from the first side edge of the sheet at the top edge of the sheet, and a second tab extending from the second side edge of the sheet at the top edge of the sheet. A crate (e.g., compatibly sized box or crate) has four vertical side panels and a generally rectangular bottom panel. The support tabs of the sheet are supported on the top edge of two of the four vertical side panels of the crate.

A ratchet wrench is attached to the sheet. The ratchet wrench has a square cross-section drive extending through the circular aperture formed in the sheet. The ratchet wrench has a handle clamped to the sheet by a pair of the plurality of clamping devices.

A plurality of sockets are held. Each socket of the plurality of sockets is held in one of the plurality of spaced apart socket holders. Each socket includes a generally cylindrical tool with a first end and an opposite second end. At the first end, a recessed opening is sized and shaped to fit over a hexagonal head of a fastener (e.g., the head of a bolt or a nut). At the second end, a square cross-section recess is configured to fit over the square cross-section drive of the ratchet wrench. The vertical tab of each of the plurality of spaced apart socket holders in which each socket is held extend through the square cross-section recess.

A plurality of spaced apart spring clamps may be attached to the sheet. Each spring clamp includes a clamp base parallel to the sheet and a pair of opposed spaced apart concave clamping arms extending from the clamp base. A ratchet wrench may be attached to the sheet with a square cross-section drive of the wrench extending through the circular aperture formed in the sheet, and a handle of the wrench clamped to the sheet by a pair of the plurality of spaced apart spring clamps.

BRIEF DESCRIPTION OF THE DRAWINGS

The foregoing and other aspects, objects, features and advantages of the invention will become better understood with reference to the following description, appended claims, and accompanying drawings, where:

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Figure 1:
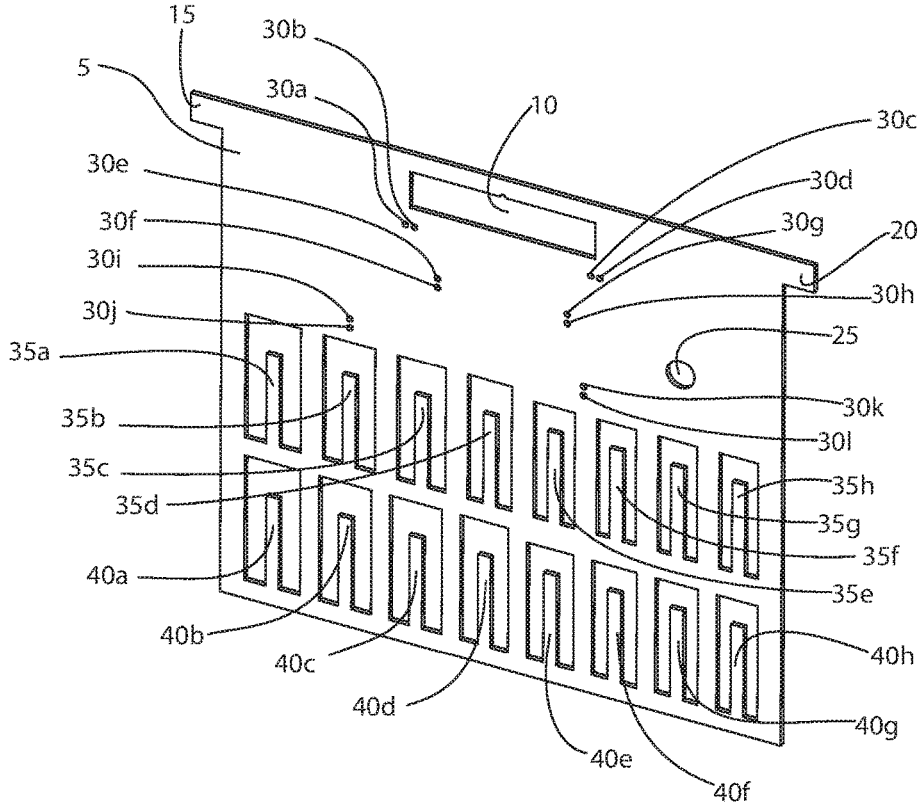
FIG. 1 provides a front perspective view of an exemplary tool holder panel according to principles of the invention.

Referring to FIG. 1, a front perspective view of an exemplary tool holder panel 5 according to principles of the invention is provided. The panel 5 is a thin rigid sheet with opposite planar sides and a plurality of apertures.

The apertures include an elongated handle opening 10 adjacent to the top edge at or near the middle, and sized and shaped to receive fingers of a gripping hand, preferably about 2.5 to 6 inches in width and about 1 to 1.5 inches in height.

A plurality of mounting holes 30*a*-30*l* are provided for attaching clamps, brackets and stops. Each mounting hole extends through the panel 5. Each mounting hole has a small diameter, preferably 1/16 to 1/2 inch and more preferably not larger than about 1/4 inch. The mounting holes 30*a*-30*l* are arranged in pairs. Each pair comprises two adjacent holes. Some pairs are horizontally oriented 30*a*-30*d*, and some pairs are vertically oriented 30*e*-30*l*. Two pairs of vertically oriented holes 30*a*-30*d* flank a pair of lower vertically oriented pairs of mounting holes 30*e*-30*h*.

A socket head aperture 25 extends through the panel 5 to receive a drive head of a socket wrench, which may, for example, be 1/4", 1/2", 3/8", 1/2", or 3/4". The aperture 25 may receive only the square drive head of a socket wrench or the square drive head along with the circular rotating base.

A plurality of socket holders 35*a*-35*h*, 40*a*-40*h* are provided in the panel. Each socket holder includes a flexible retaining tab extending vertically from the bottom edge of a rectangular aperture to about between 2/3 and 3/4 of the height of the rectangular aperture. The structure of each socket holder 35*a*-35*h*, 40*a*-40*h* is described more fully below. The width of each flexible tab is up to about the size of the square opening in the socket to be held, i.e., up to 1/4" for a 1/4" drive socket, up to 1/2" for a 1/2" drive socket, up to 3/8" for a 3/8" drive socket, up to 1/2" for a 1/2" drive socket, and up to 3/4" for a 3/4" drive socket. The height and width of the rectangular opening are greater than the height and width of the socket to be held.

Figure 2:
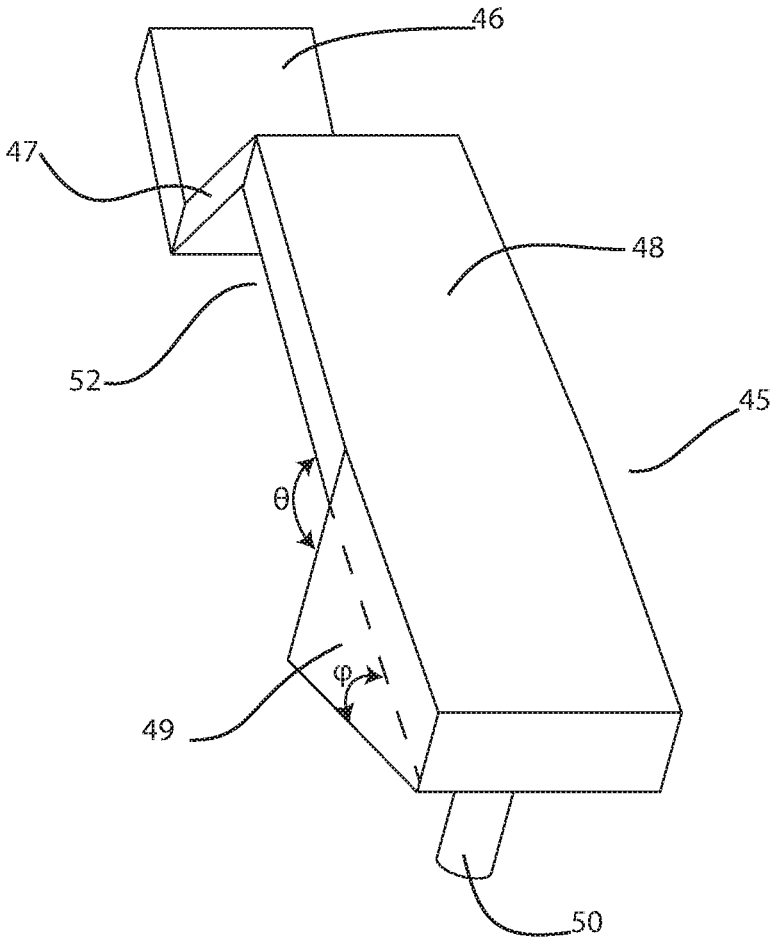
FIG. 2 is a first perspective view of an exemplary clamping device for an exemplary tool holder according to principles of the invention.
Figure 3:
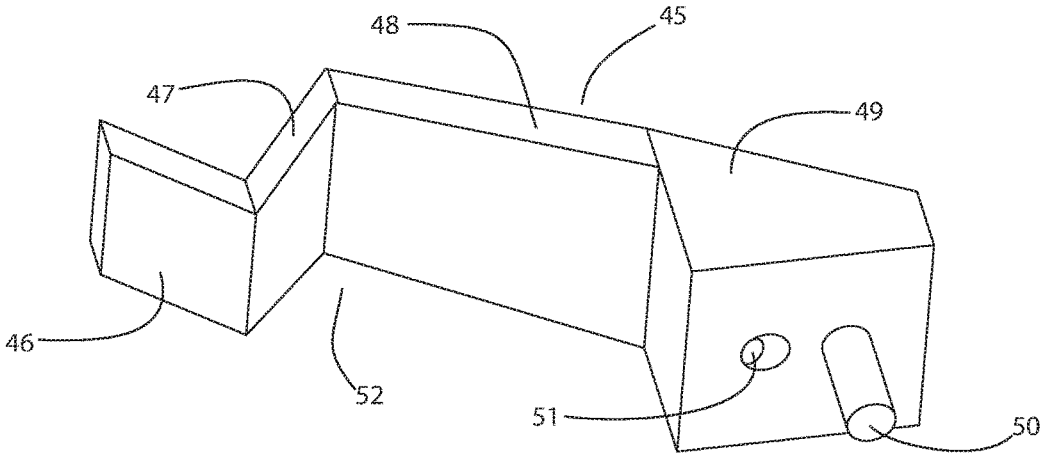
FIG. 3 is a second perspective view of an exemplary clamping device for an exemplary tool holder according to principles of the invention.

Various clamping and holding devices are attached to the panel 5 to secure tools (e.g., a ratchet wrench and extension) to the panel. An exemplary clamping device 45 is illustrated in FIGS. 2 and 3. The clamping device 45 is a plastic structure which includes a base 49, clamp mounting pin 50 and mounting hole 51. The clamp mounting pin 50 plugs into one of the pairs mounting holes 30*a*-30*l*, while the mounting hole 51 aligns with an adjacent hole of the pair of mounting holes. A screw extends through a mounting hole 30*a*-30*l* in the panel 5 from the back side of the panel 5 into the mounting hole 51 of the clamping device 45. The hole 51 may be threaded or a screw may form threads as it advances in the hole 51 of the plastic clamping device 45. Thus, the clamping device 45 is pinned or attached to the panel 5 at two points.

A flexible arm 48 extends from the base at an obtuse angle θ (less than 180°) relative to an axis perpendicular to the face of the panel 5, and at an acute angle φ relative to the panel 5 and the planar surface of the clamping device 45 that abuts and is parallel to the panel 5. Thus, when the clamp 45 is attached to the panel, the arm extends outwardly from the base away from the panel. The underside of the arm defines a clamping space 52 (e.g., cavity) between the arm 48 and panel 5 in which a tool is held when the clamping device 45 is affixed to the panel 5.

A distal elbow is formed by terminal and intermediate segments 46 and 47. The terminal segment is about parallel to the arm 48. The elbow defines an angled constricting entrance to the clamping space 52 between the arm 48 and the panel 5. The constriction formed by the elbow helps to prevent clamped items from inadvertently dislodging from the clamp 45 through the entrance. The terminal segment 46 of the elbow also provides a surface that can easily be deflected away from the panel 5 with a finger to release a clamped tool.

Figure 4:
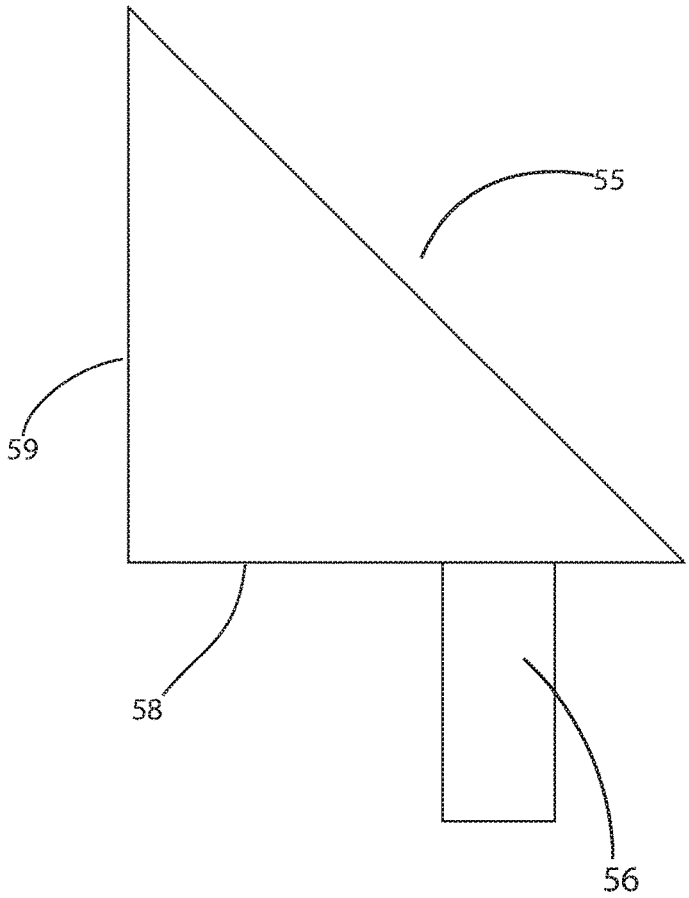
FIG. 4 is a side view of an exemplary wedge for an exemplary tool holder according to principles of the invention.
Figure 5:
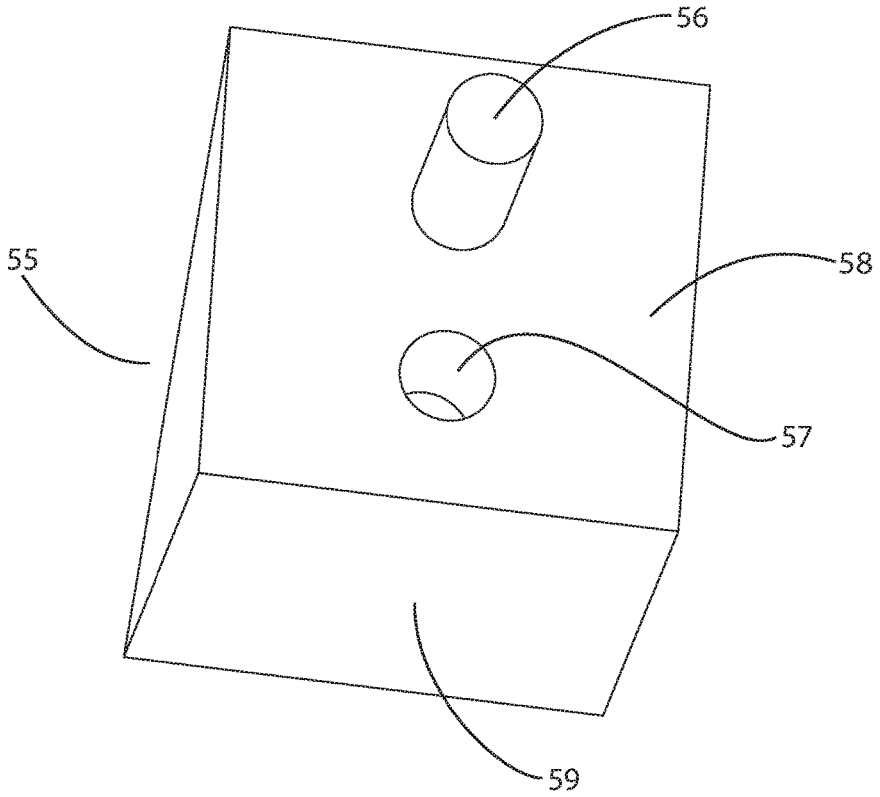
FIG. 5 is a first perspective view of an exemplary wedge for an exemplary tool holder according to principles of the invention.

In FIGS. 4 and 5, a wedge 55 is illustrated. The wedge 55 includes a planar base surface 58 that abuts (and is parallel to) the panel 5 when the wedge 55 is attached to the panel 5.

The base surface 58 includes a clamp mounting pin 56 and mounting hole 57. The clamp mounting pin 56 plugs into one of the pairs mounting holes 30*a*-30*l*, while the mounting hole 57 aligns with an adjacent hole of the pair of mounting holes. A screw extends through a mounting hole 30*a*-30*l* in the panel 5 from the back side of the panel 5 into the mounting hole 57 of the wedge 45. The hole 57 may be threaded or a screw may form threads as it advances in the hole 57 of the wedge 55. Thus, the wedge 55 is pinned or attached to the panel 5 at two points.

The wedge 55 includes a blocking surface 59. The blocking surface 59 is generally perpendicular to the base surface 58. However, it may be oriented at an angle other than 90 degrees relative to the base surface 58, such as 70 degrees to 110 degrees relative to the base surface 58. A blocking surface 59 of a wedge 55 may positioned alongside a clamping space 52 to prevent clamped objects from sliding out from between the clamp 45 and panel 5.

Figure 6:
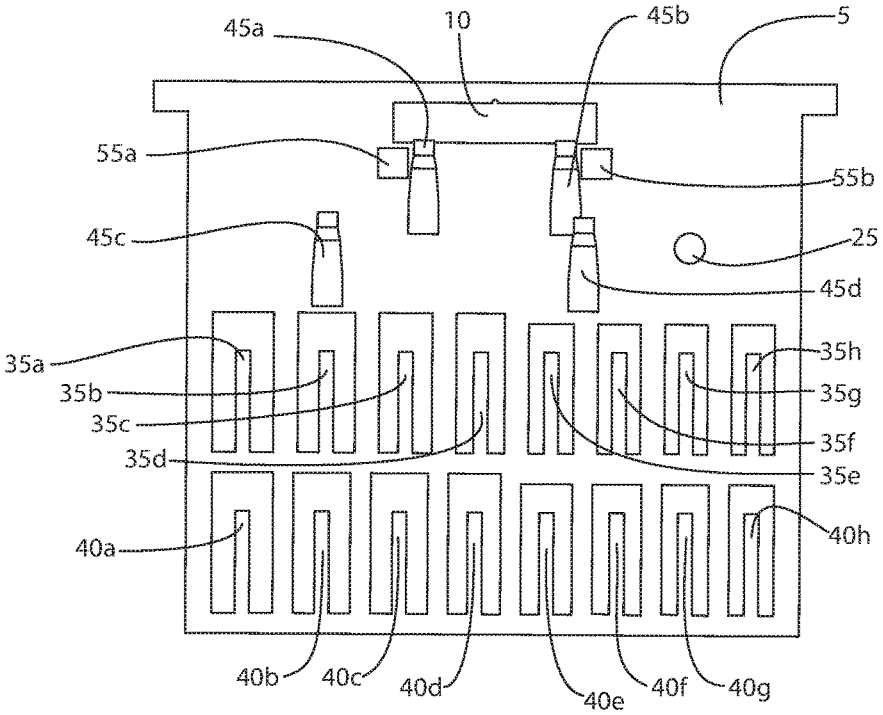
FIG. 6 is a front view of an exemplary tool holder panel with attached clamping devices and wedges according to principles of the invention.
Figure 7:
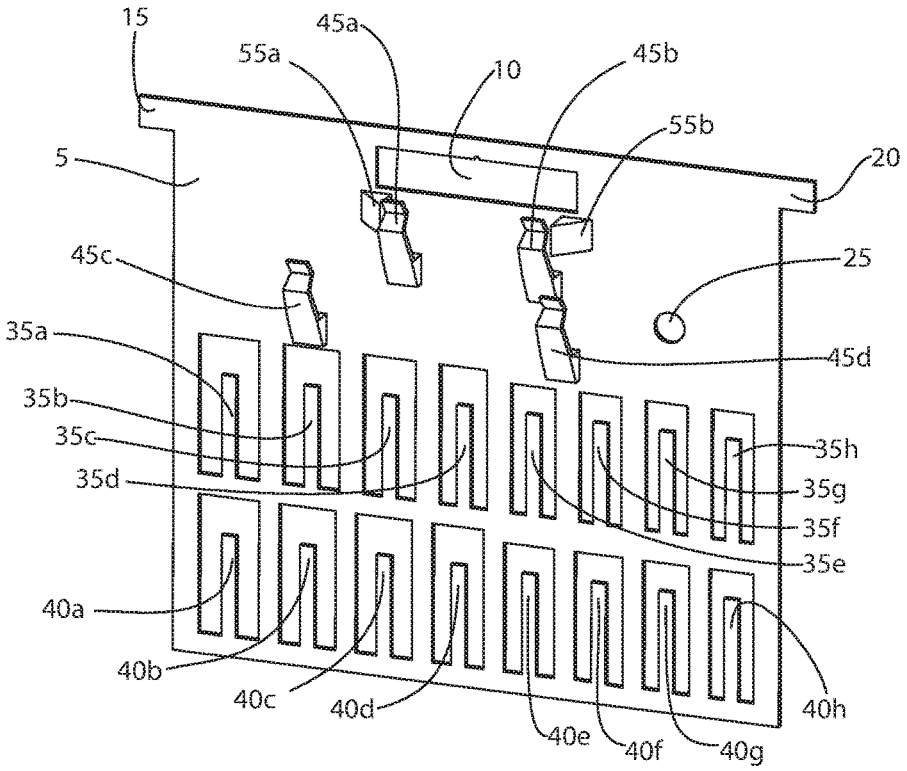
FIG. 7 is a front perspective view of an exemplary tool holder panel with attached clamping devices and wedges according to principles of the invention.

FIGS. 6 and 7 illustrate the panel 5 with clamping devices 45*a*-45*d* and wedges 55*a*-55*b* installed. In the illustrated exemplary embodiment, the clamping devices 45*a*-45*d* are installed using vertically oriented pairs of mounting holes 30*e*-30*f*, 30*g*-30*h*, 30*i*-30*j*, and 30*k*-30*l*. In the illustrated exemplary embodiment, the wedges 55*a*-55*b* are installed using horizontally oriented pairs of mounting holes 30*a*-30*b* and 30*c*-30*d*.

Figure 8:
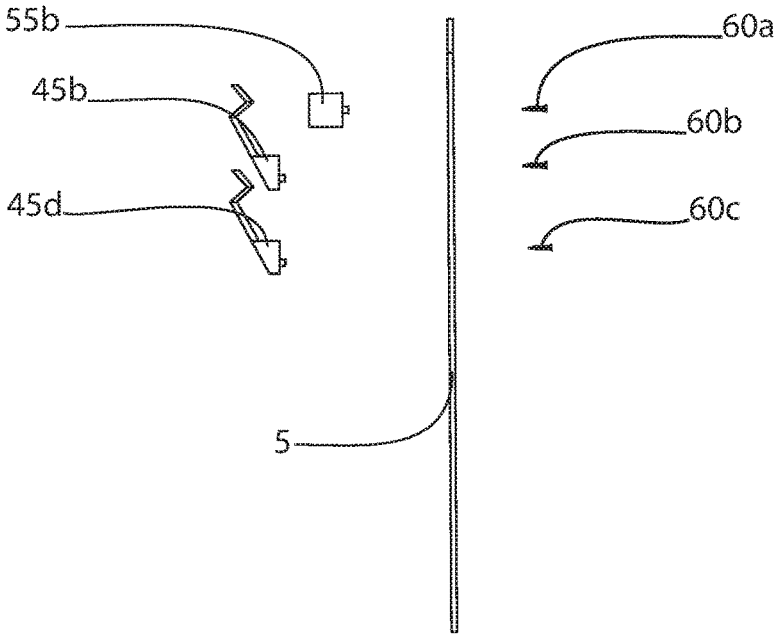
FIG. 8 is an exploded side view of an exemplary tool holder panel with removed clamping devices and wedges according to principles of the invention.

FIG. 8 provides an exploded profile view with clamping devices 45*b*, 45*d* and wedges 55*b* removed, and screws 60*a*-60*c* for threadedly extending through mounting holes in the panel 5 into corresponding holes in the clamping devices 45*b*, 45*d* and wedges 55*b*. Without the clamping devices 45*b*, 45*d* and wedges 55*b* installed, the panel 5 is a substantially planar thin sheet. Clamping devices 45*a*, 45*c* are hidden behind clamping devices 45*b*, 45*d* and wedge 55*a* is hidden behind wedge 45*b* in the profile view.

Figure 9:
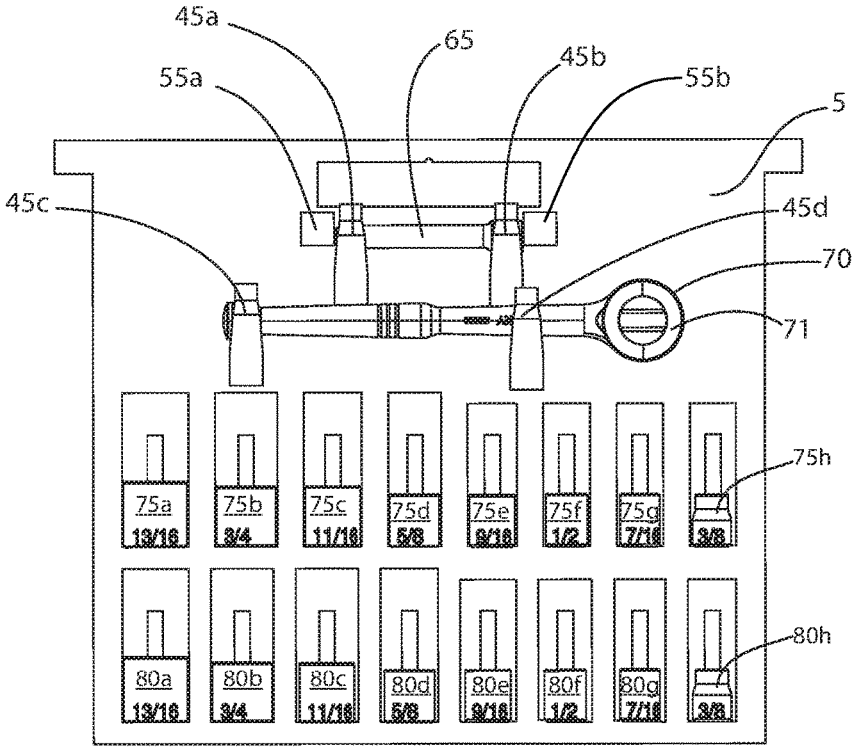
FIG. 9 is a front view of an exemplary tool holder panel with attached clamping devices, wedges and tools according to principles of the invention.
Figure 10:
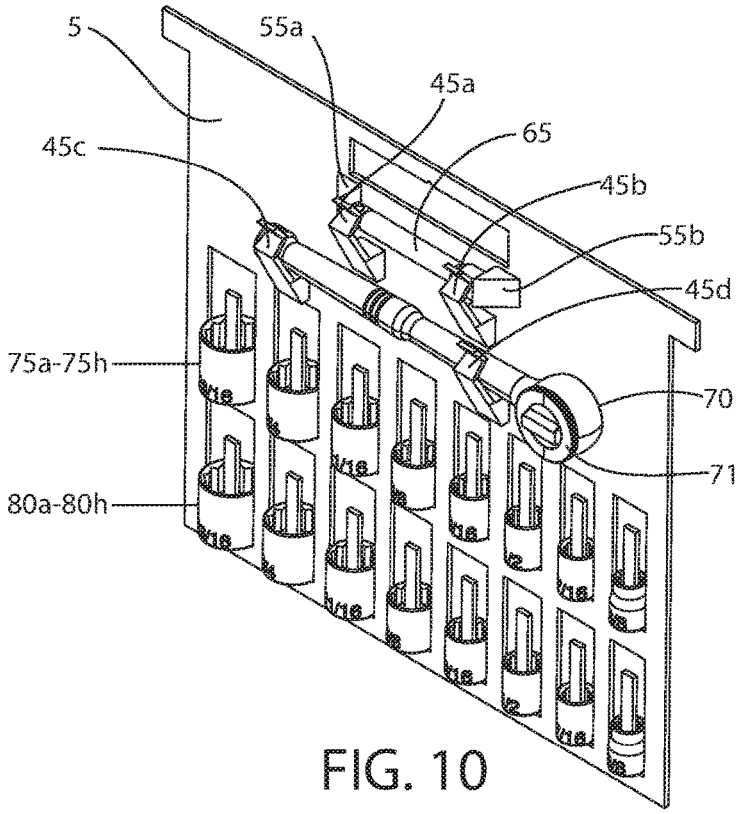
FIG. 10 is a front perspective view of an exemplary tool holder panel with attached clamping devices, wedges and tools according to principles of the invention.

FIGS. 9 and 10 illustrate the panel 5 with the clamping devices 45*a*-45*d*, wedges 55*a*-55*b*, ratchet wrench 70, extension 65, and sockets 75*a*-75*h*, 80*a*-80*h* installed. A portion of the drive head 71 is received in the aperture 25. Clamping devices 45*c*-45*d* secure the wrench 70 against the panel 5. Clamping devices 45*a*-45*b* and wedges 55*a*-55*b* secure the extension 65 against the panel 5 and prevent the extension 65 from sliding out. Various sockets, e.g., 6 point 75*a*-75*h* and 12 point 80*a*-80*h*, are installed on tabs socket tabs 35*a*-35*h*, 40*a*-40*h*.

Figure 11:
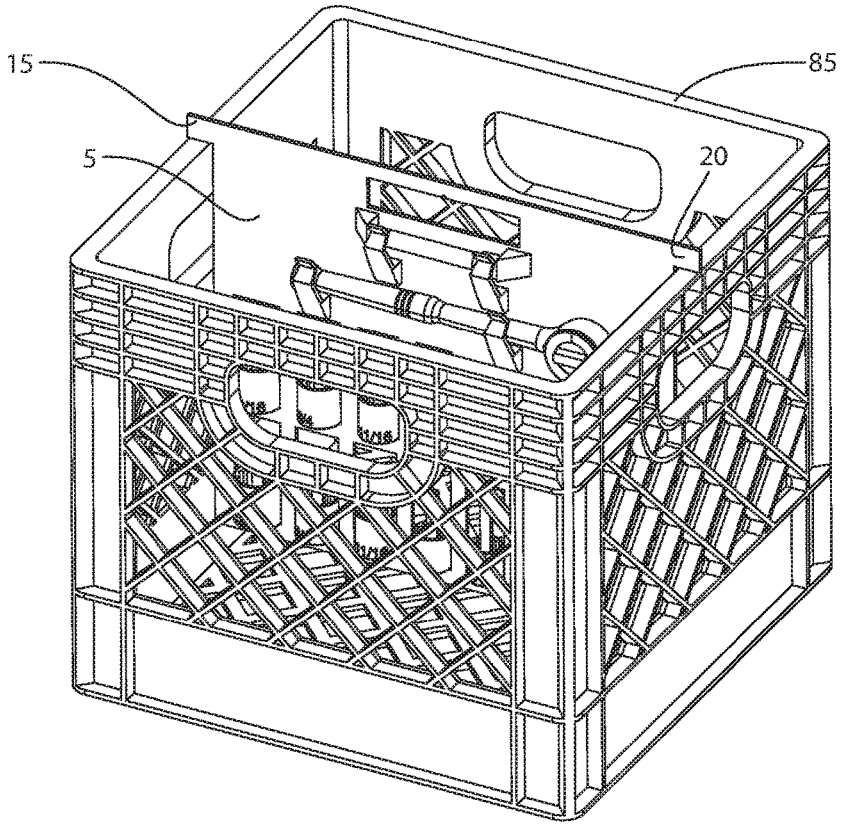
FIG. 11 is a front perspective view of an exemplary tool holder panel with attached clamping devices, wedges and tools installed in a crate according to principles of the invention.
Figure 13:
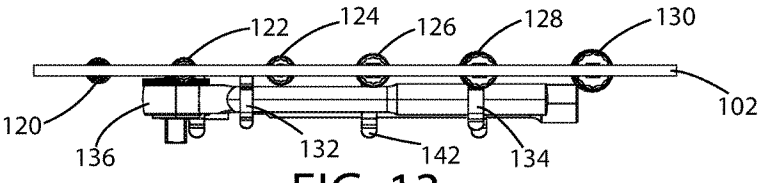
FIG. 13 is a plan view of an exemplary holder and storage device according to principles of the invention.
Figure 12:
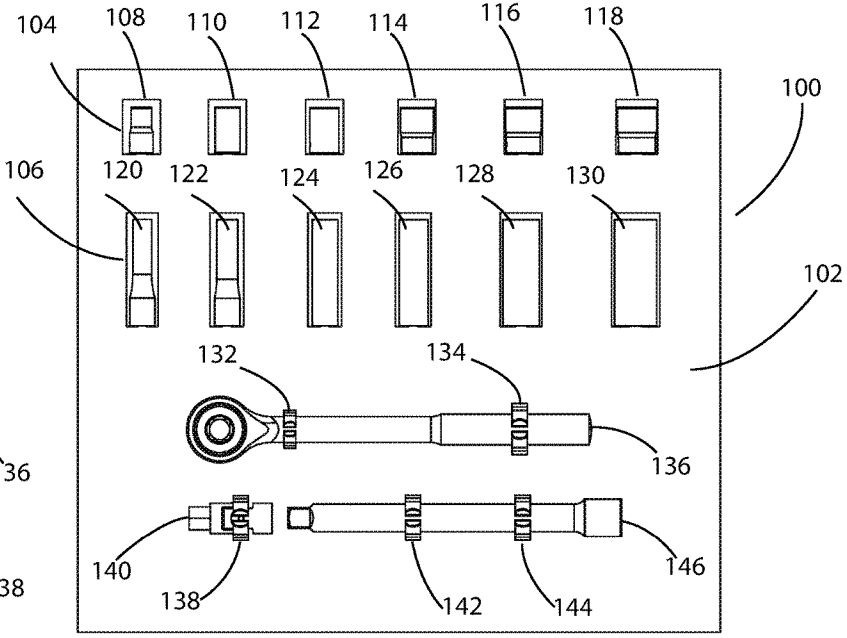
FIG. 12 is a front view of an exemplary holder and storage device according to principles of the invention.
Figure 14:
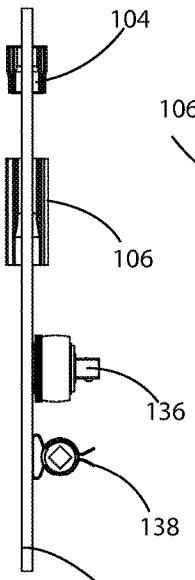
FIG. 14 is a side view of an exemplary holder and storage device according to principles of the invention.
Figure 15:
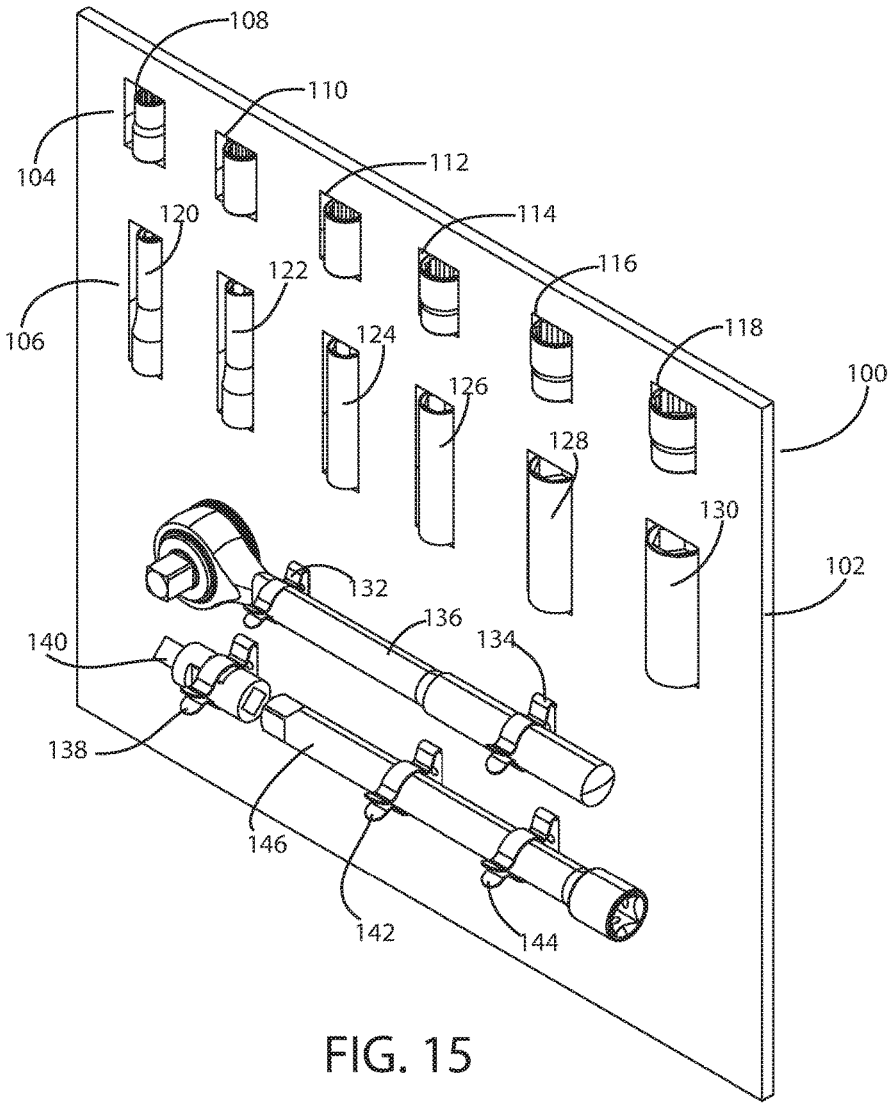
FIG. 15 is a front top perspective view of an exemplary holder and storage device according to principles of the invention.

FIG. 11 illustrates the panel 5 installed in a crate 85. The exemplary crate 85 is a milk crate with parallel sides upon which support tabs 15, 20 of the panel may rest. While a milk crate is depicted, it is understood that the invention is not limited to use with a milk crate. Rather other crates having parallel sides spaced apart a sufficient distance to support the support tabs 15, 20. Alternatively, a drawer with properly spaced file rails may be used. The support tabs may be suspended upon the file rails.

With reference now to FIGS. 12 through 15, another embodiment of a tool holder 100 according to principles of the invention is comprised of a plastic sheet 102 with a plurality of tabbed cutouts 108-118, each of which is sized and configured to hold a socket 120-130. A socket is typically generally a cylindrical tool which has a female six or twelve-point recessed opening sized to fit over a common male hexagonal head of a fastener. The opposite end of the socket has a standardized square recess to accept a wrench's square fitting (i.e., drive) that contains a spring-loaded ball detent mechanism to keep the socket in place.

The tabbed cutouts 108-118, which are described in greater detail below, include a tab that fits into the square recess of a socket. The tab can be deflected. Depending upon the relative sizes of the socket and cutouts, a socket may be dislodged from a tabbed cutout only by angularly deflecting the tab, such as by pushing or pulling on the engaged socket. However, in some embodiments, deflection may be unnecessary.

While two rows 104, 106 of tabbed cutouts holding sockets are shown, the invention may be applied to a sheet with a single tabbed cutout for holding a single socket, or a sheet with multiple tabbed cutouts for holding multiple sockets, and whether or not the tabbed cutouts are arranged in columns and rows.

The tool holder 100 may also include various clamps 132, 134, 138, 142, 144 for holding tools, such as a ratchet wrench 136 to which the sockets attach, a universal joint 140, and an extension 146. The clamps 132, 134, 138, 142, 144 may comprise spring clamps, such as clamps with one or two arms biased for holding an object between the arms or against the sheet 102. Manually actuated clamps may be used in addition to or in lieu of spring clamps. Tie down straps may also be used in addition to or in lieu of spring clamps. The invention is not limited to an embodiment with the number or arrangement of clamps shown. Rather, embodiments devoid of clamps, and embodiments with different clamps, and other numbers of an arrangements of clamp come within the scope of the invention.

Figure 16:
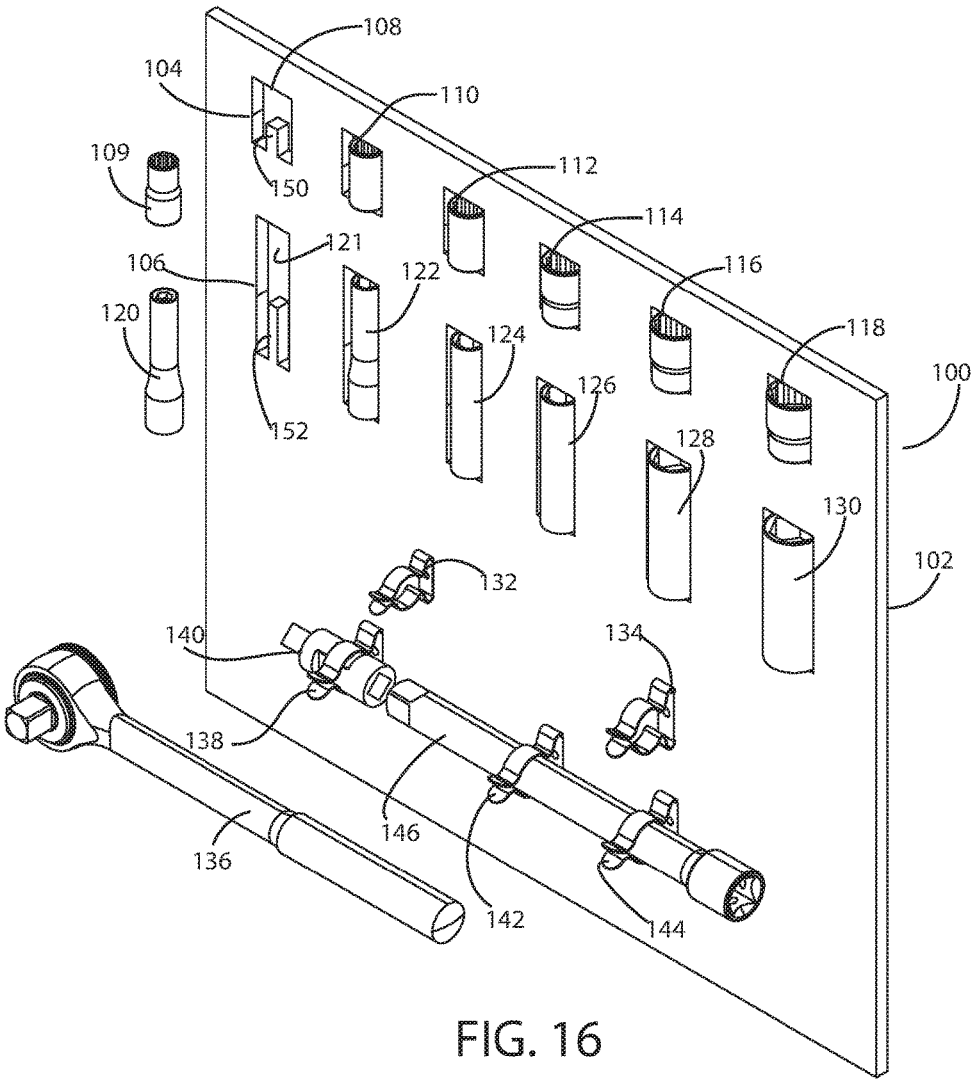
FIG. 16 is a front top perspective view of an exemplary holder and storage device with a few sockets removed according to principles of the invention.
Figure 17:
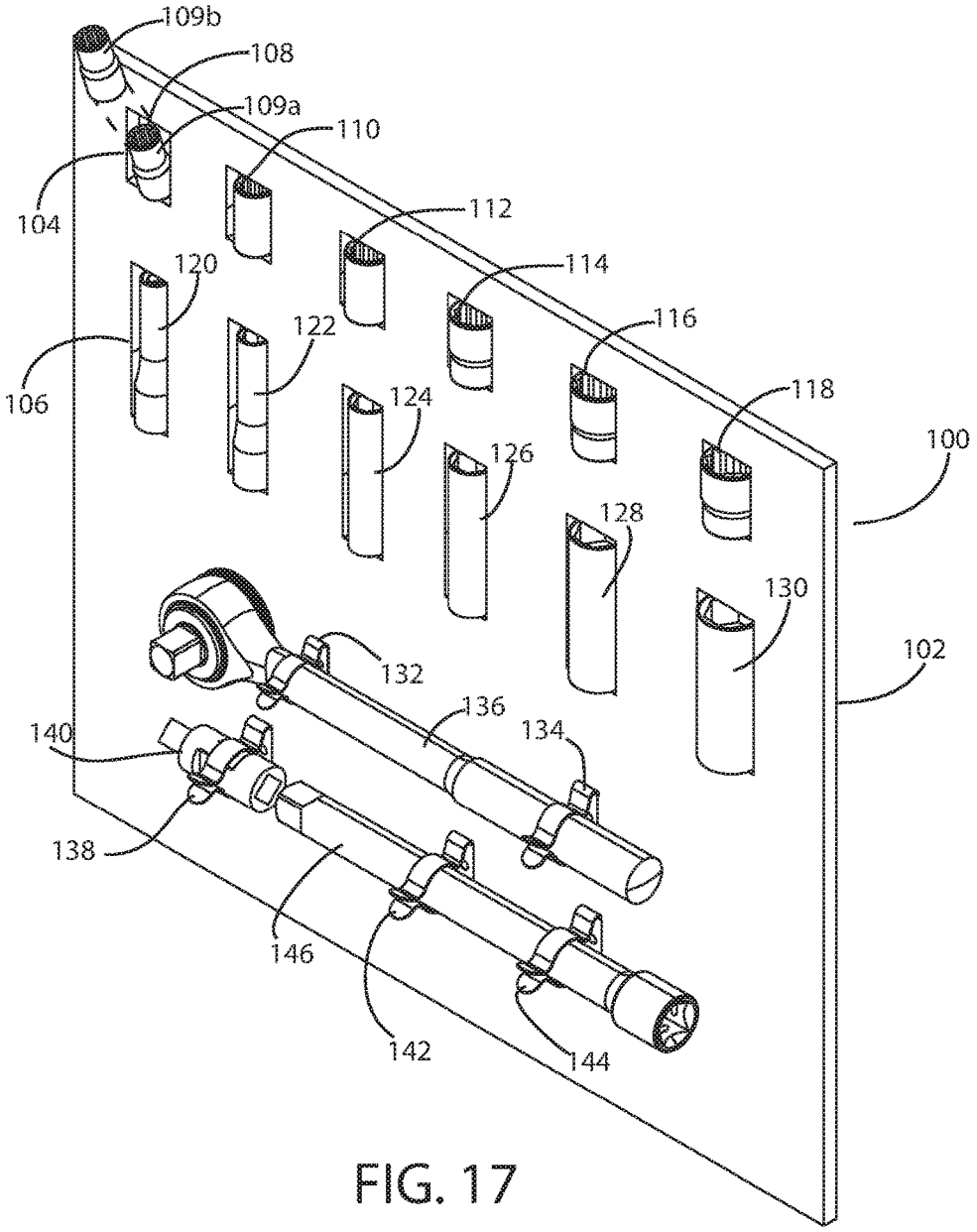
FIG. 17 is a front top perspective view of an exemplary holder and storage device with a socket being removed according to principles of the invention.

In FIGS. 16 and 17, a socket is shown in various states of removal from cutout 108. The socket 109*a* is shown on the deflected tab of the cutout 108 and slid off (i.e., removed) 109*b* from the tab. The tab may be deflected by pushing or pulling the end of the socket opposite the tab.

Figure 18:
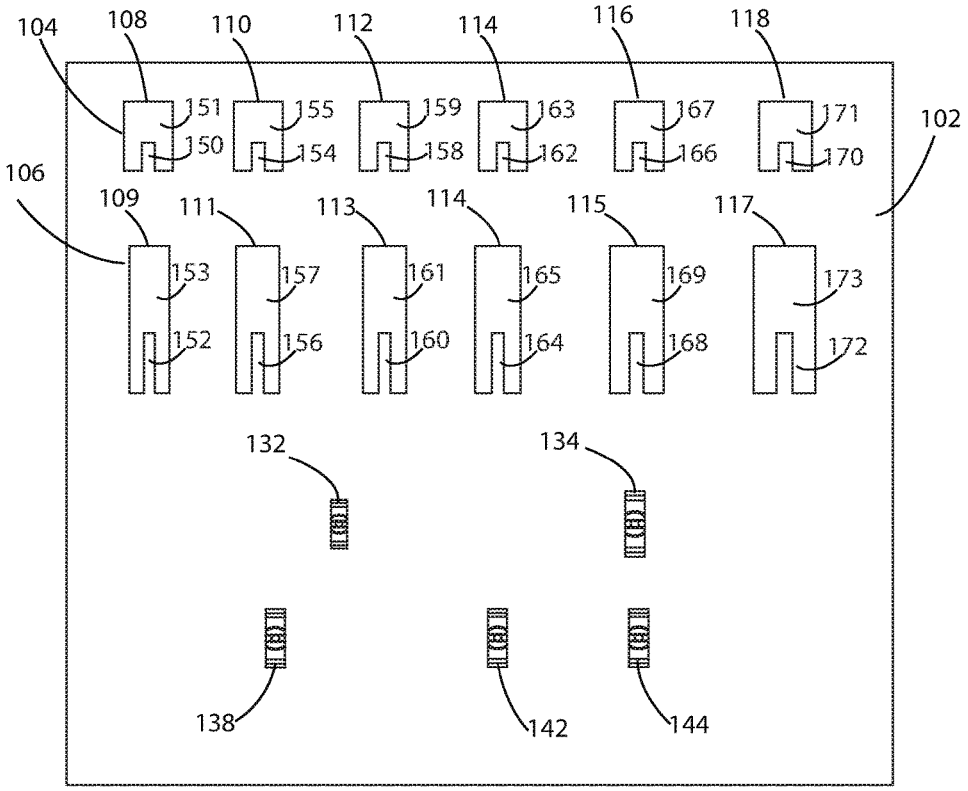
FIG. 18 is a front view of an exemplary holder and storage device without any tools according to principles of the invention.
Figure 19:
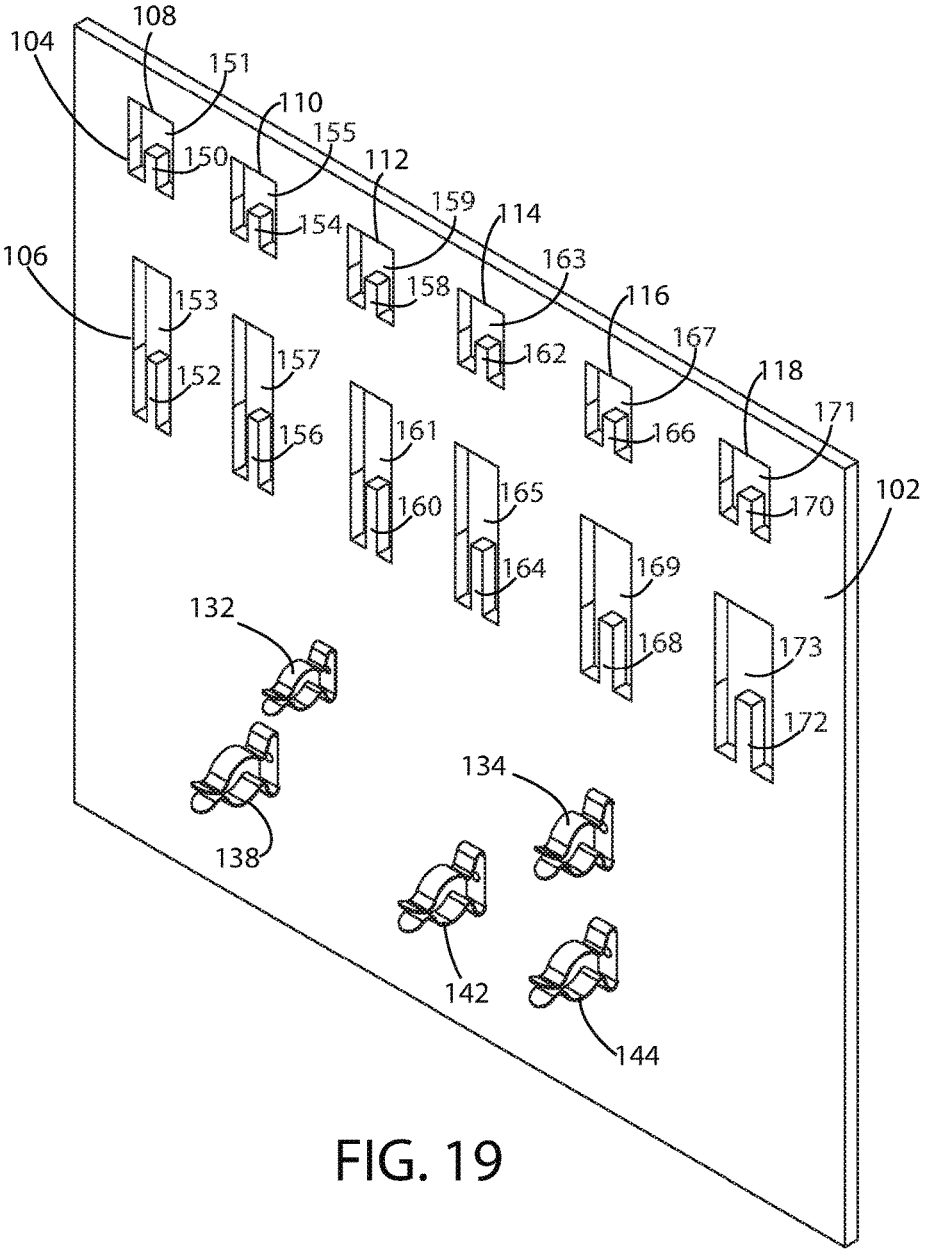
FIG. 19 is a front top perspective view of an exemplary holder and storage device without any tools according to principles of the invention.

The tabbed cutouts 108-118, which are more clearly visible in FIGS. 18 and 19, which depict the sheet 102 without any tools. Each cutout 108-118 defines a U-shaped opening 151, 153, 155, 157, 159, 161, 163, 165, 167, 169, 171, 173 through the sheet. Each cutout 108-118 includes a tab 150, 152, 154, 156, 158, 160, 162, 164, 166, 168, 170, 172 defined by the U-shaped opening 151, 153, 155, 157, 159, 161, 163, 165, 167, 169, 171, 173. The tab 150, 152, 154, 156, 158, 160, 162, 164, 166, 168, 170, 172 is shaped and sized to fit into the square recess of a socket. The tab may fit loosely, snugly or in between the extremes. The tab is deflectable. The U-shaped opening 151, 153, 155, 157, 159, 161, 163, 165, 167, 169, 171, 173 is sized so that a socket may be dislodged only by angular deflection of the tab 150, 152, 154, 156, 158, 160, 162, 164, 166, 168, 170, 172, such as by pushing or pulling on an engaged socket. Unless the tab 150, 152, 154, 156, 158, 160, 162, 164, 166, 168, 170, 172 is deflected, the space provided by the U-shaped opening 151, 153, 155, 157, 159, 161, 163, 165, 167, 169, 171, 173 is insufficient to permit disengagement of an engaged socket. In some embodiments, e.g., with frequently used sockets, deflection may be unnecessary.

In FIGS. 20 through 25, two nonlimiting examples of tabbed cutouts are illustrated. The embodiment in FIGS. 20 through 22 includes a generally U-shaped cutout 205 defining a tab 210 flanked by spaces 215, 220. The width, w1, of the cutout is equal to or greater than the outer diameter of a socket to be engaged. The height, h1, of the cutout is greater than the height of a socket to be engaged, i.e., greater by about 5 to 25% of the height of the socket. The width, w2, and height, h2, of the tab 210 are not greater than the width and height of the square drive recess in a socket. The thickness of the sheet is also not greater than the width of the square drive recess. This allows the tab 210 to reside in the recess of an engaged socket. The sheet 200 and thus the integrally formed tab 210 are comprised of a resilient plastic. The tab 210 acts like a cantilevered beam that can be deflected, as shown in FIG. 11, by applying a force with a normal component at or near the free end of the tab 210.

Figure 20:
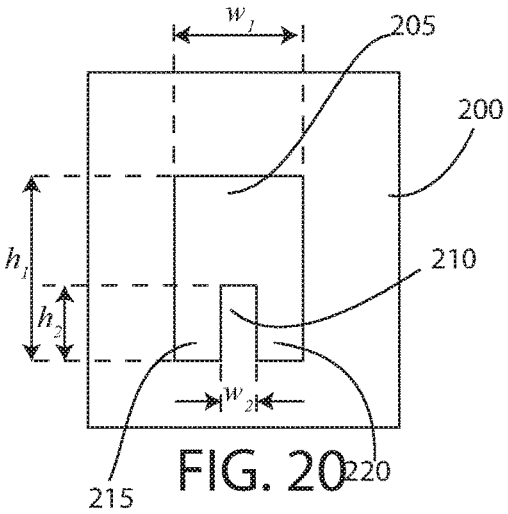
FIG. 20 is a front view of an exemplary tabbed cutout for an exemplary holder and storage device without any tools according to principles of the invention.
Figure 21:
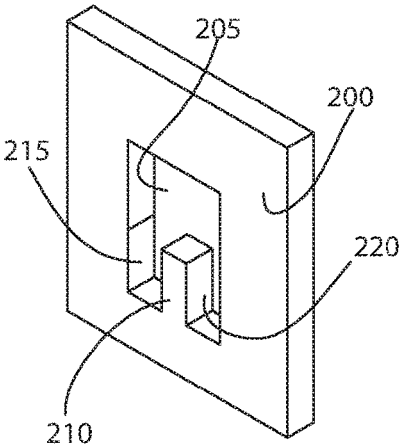
FIG. 21 is a front top perspective view of an exemplary tabbed cutout for an exemplary holder and storage device without any tools according to principles of the invention.

Such deflection provides adequate clearance for removal and installation of a socket. Upon removing the force, the resilient plastic tab 210 returns to its undeflected state as shown in FIGS. 20 and 21. In some embodiments, such as with frequently used sockets, the cutouts and tabs may be sized to allow removal with minimal or without any deflection.

Figure 23:
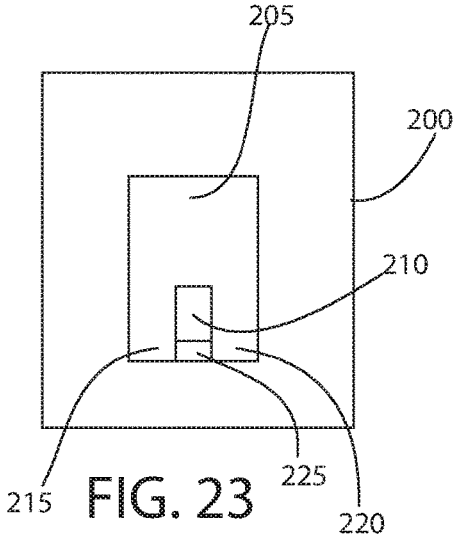
FIG. 23 is a front view of another exemplary tabbed cutout for an exemplary holder and storage device without any tools according to principles of the invention.
Figure 24:
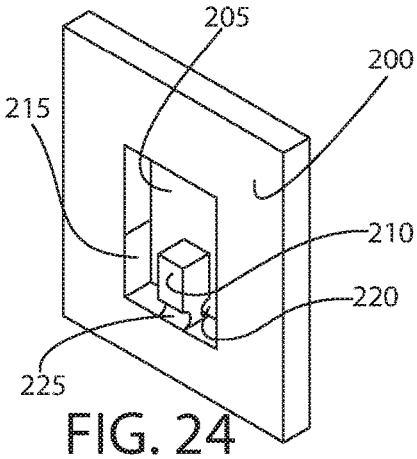
FIG. 24 is a front top perspective view of the other exemplary tabbed cutout for an exemplary holder and storage device without any tools according to principles of the invention.
Figure 22:
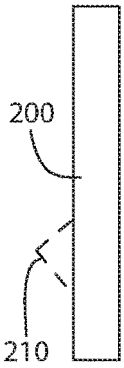
FIG. 22 is a side view of an exemplary tabbed cutout for an exemplary holder and storage device without any tools according to principles of the invention.
Figure 25:
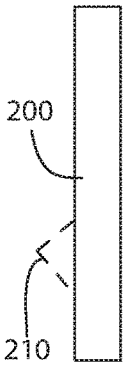
FIG. 25 is a side view of an exemplary tabbed cutout for the other exemplary holder and storage device without any tools according to principles of the invention.

FIGS. 23 through 25 illustrate a similar tabbed cutout, except that the tab includes grooves 220, 225 at the attached end, which is where bending occurs when the tab is deflected. The grooves facilitate deflection, while reducing stress concentrations. The grooves may be semicircular in cross section, v-shaped, or some other shape. In this embodiment, the tab behaves like a resilient living hinge. The groove may be formed by stamping or machining into or molding the plastic during manufacturing.

Figure 26:
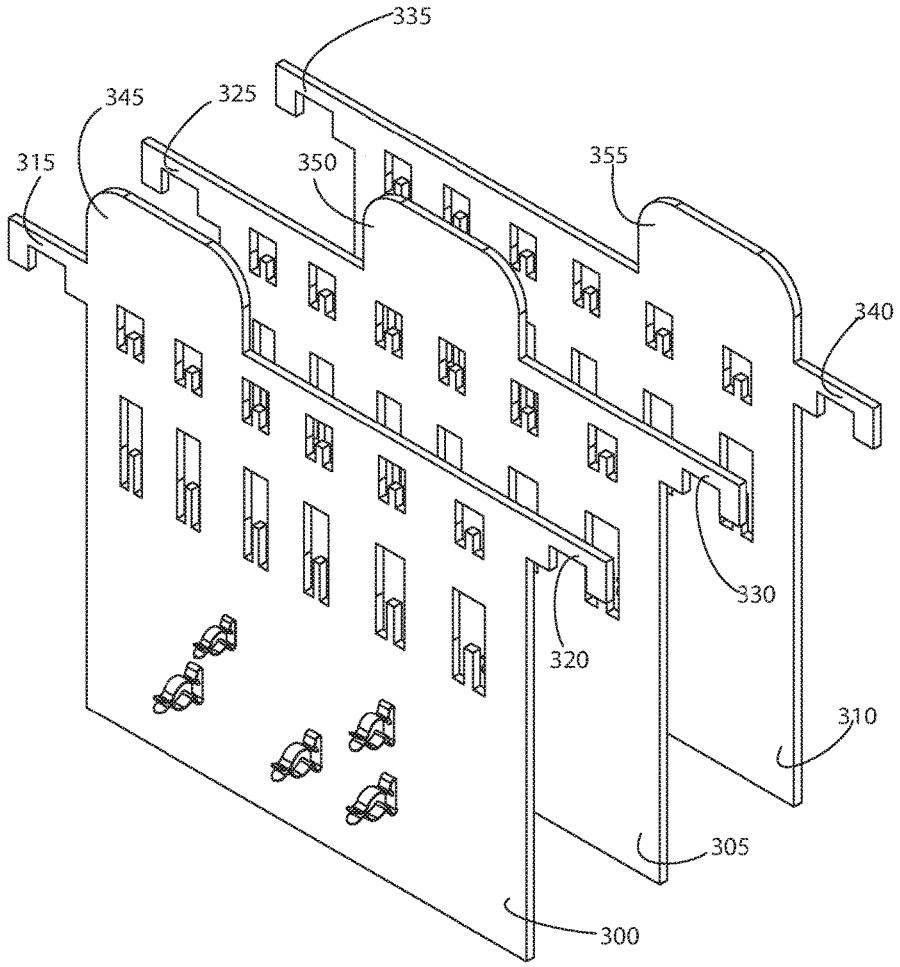
FIG. 26 is a front top perspective view of a plurality of exemplary holders and storage devices, with file organizing tabs and file hanging arms, and without any tools, according to principles of the invention.
Figure 27:
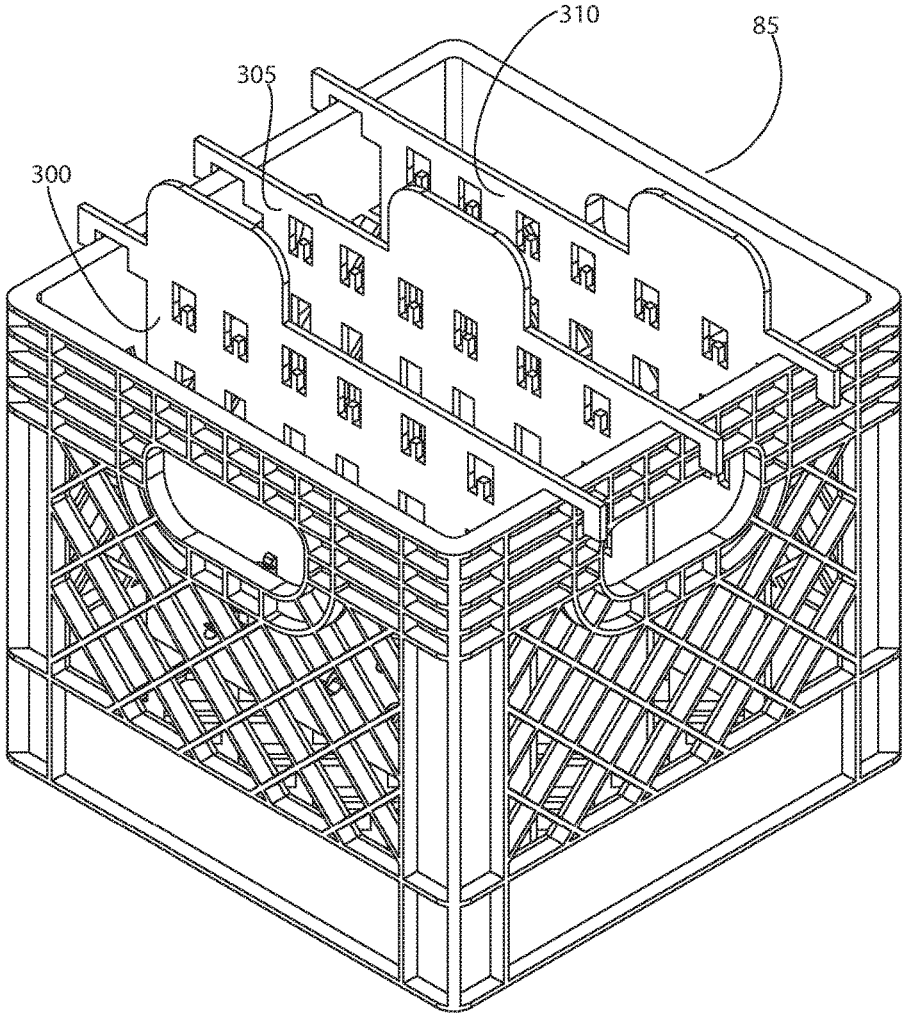
FIG. 27 is a front top perspective view of a plurality of exemplary holders and storage devices, with file organizing tabs and file hanging arms, and without any tools, with the exemplary holders and storage devices in a crate, according to principles of the invention.
Figure 28:
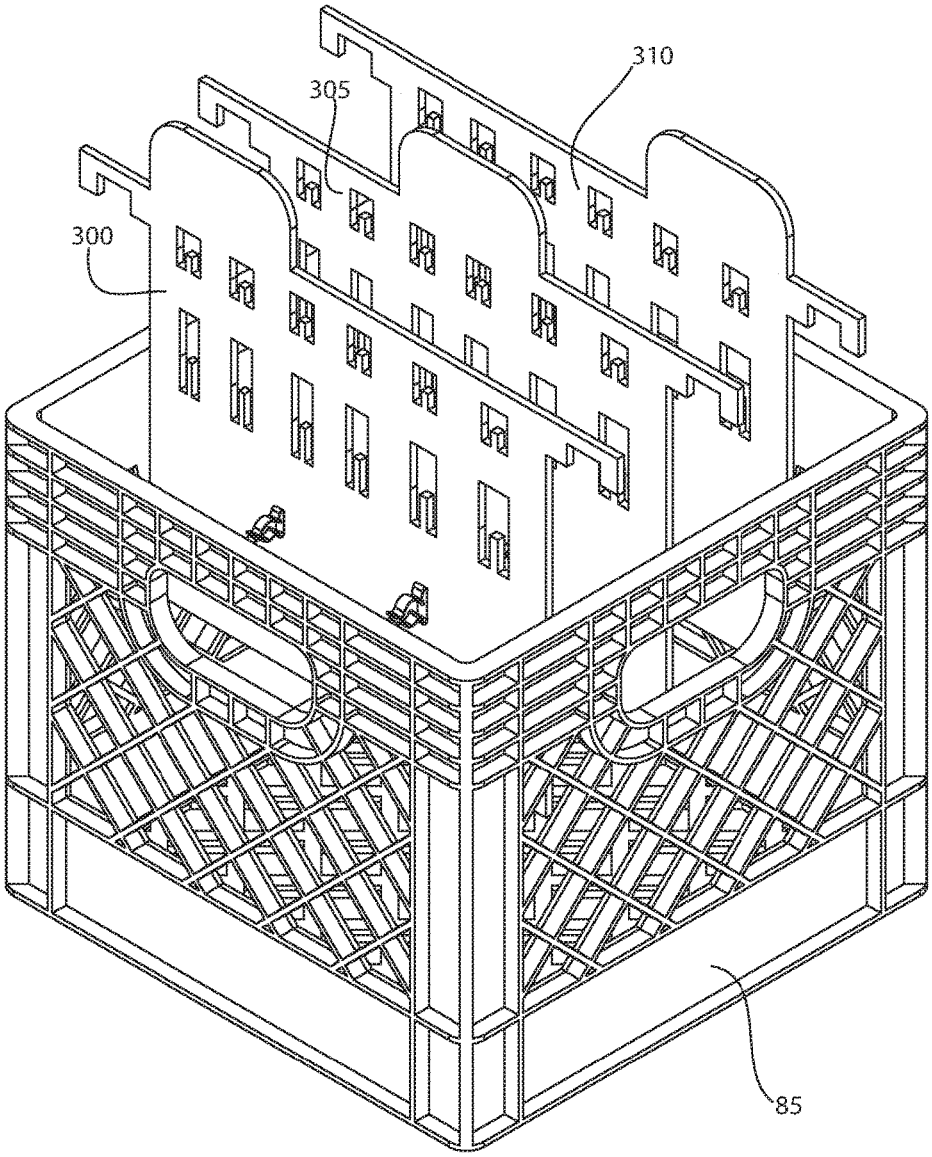
FIG. 28 is a front top perspective view of a plurality of exemplary holders and storage devices, with file organizing tabs and file hanging arms, and without any tools, with the exemplary holders and storage devices being removed or inserted into a crate, according to principles of the invention.

In FIGS. 26 through 28, embodiments of sheets 300, 305, 310 with optional additional features are shown. A filing (support) tab 345, 350, 355 is provided at the top edge of each sheet 300, 305, 310. A label or writing may be provided on the filing tab 345, 350, 355 to readily indicate to an observer the type of tools held on the sheet. Filing tabs may be arranged in an offset manner so that each filing tab is visible when the sheets 300, 305, 310 are stored. The tabs may be integrally formed or separate attachable components.

The exemplary sheets 300, 305, 310 also include hanging arms 315-340. A pair of arms 315 and 320, 325 and 330, 335 and 340, extend horizontally from the top of each sheet 300, 305, 310. Each arm 315-340 may include a cutout, notch or groove sized to engage the sidewalls of a storage container, such as a milk crate 85, as shown in FIGS. 27 and 28. The arms may be integrally formed or separate attachable components.

Figure 29:
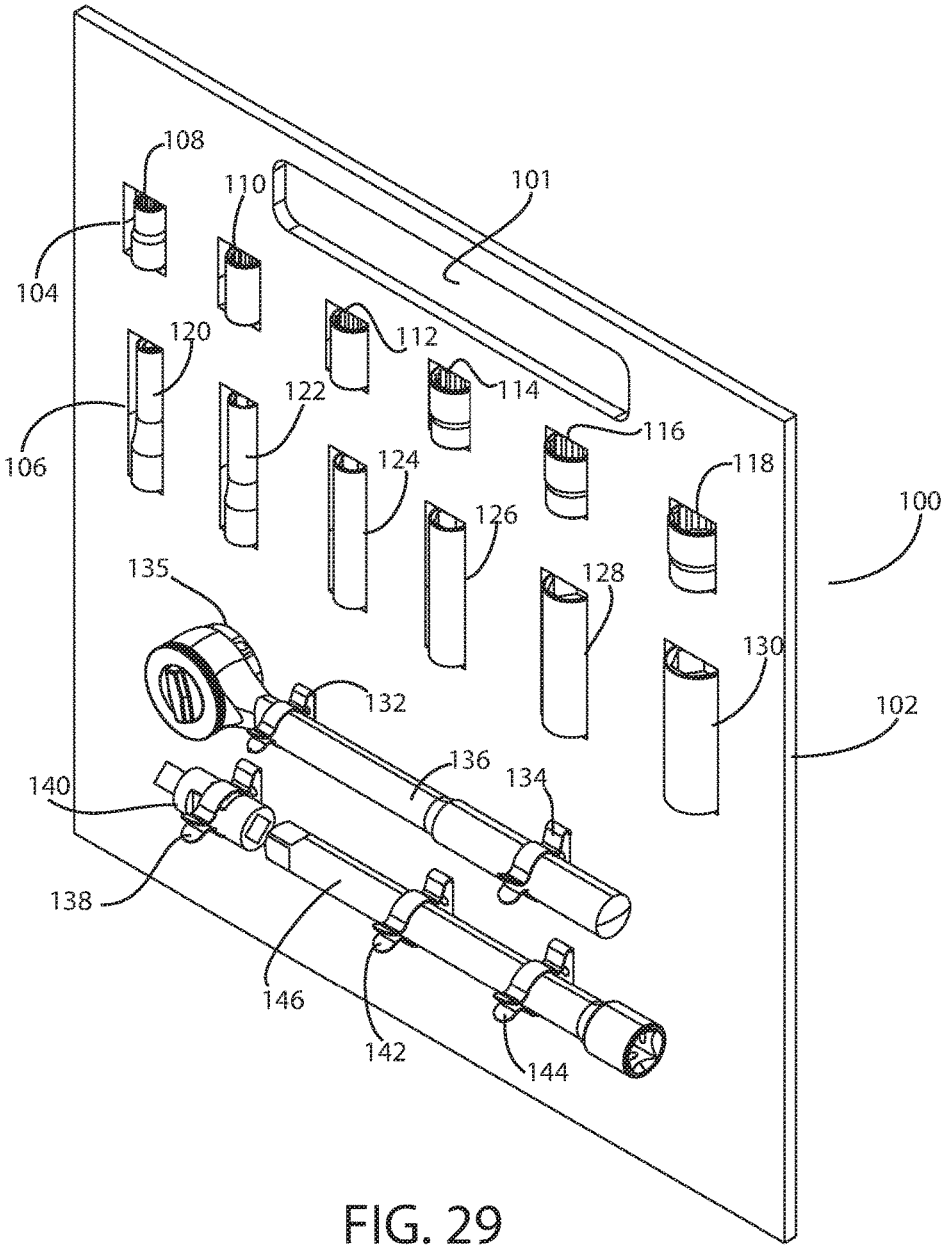
FIG. 29 is a front top perspective view of an exemplary holder and storage device, with a handle and aperture for a drive of a wrench, according to principles of the invention.
Figure 30:
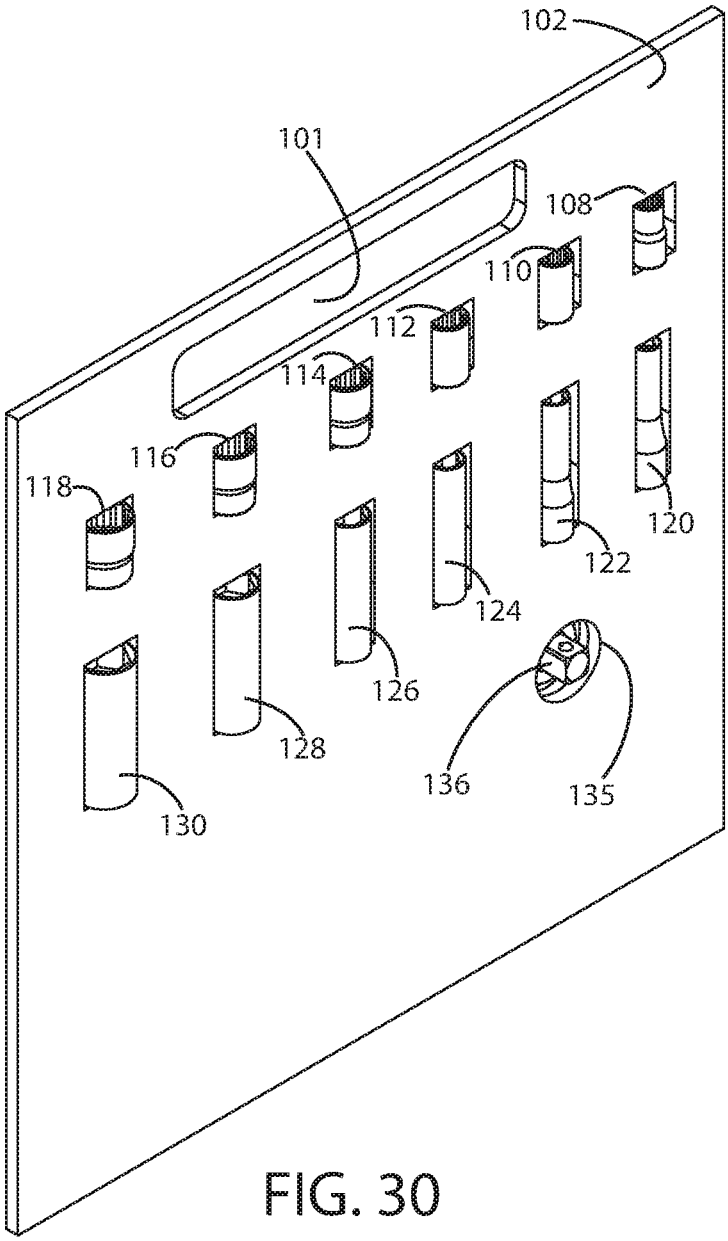
FIG. 30 is a rear top perspective view of the exemplary holder and storage device, with a handle and aperture for a drive of a wrench, according to principles of the invention.

In FIGS. 29 and 30, front and rear perspective views are provided for embodiments that include an aperture 135 for receiving the square drive of a wrench 136. Various apertures may be provided for mounting wrenches and accessories as flush against the sheet 102 as practicable. The invention is not limited to an embodiment with any such aperture, one such aperture, or a plurality of such apertures. Embodiments without such apertures, embodiments with one such aperture located differently, and embodiments with several such apertures may all come within the scope of the invention.

Additionally, the embodiment in FIGS. 29 and 30 includes a handle 101. The handle 101 comprises an aperture near an edge (e.g., the top edge). The aperture is sized to receive fingers of a gripping hand. The invention is not limited to an embodiment with any handle, one handle, or a plurality of handles. Embodiments without handles, embodiments with a handle located other than near the top edge, and embodiments with several handles may all come within the scope of the invention.

Figure 31:
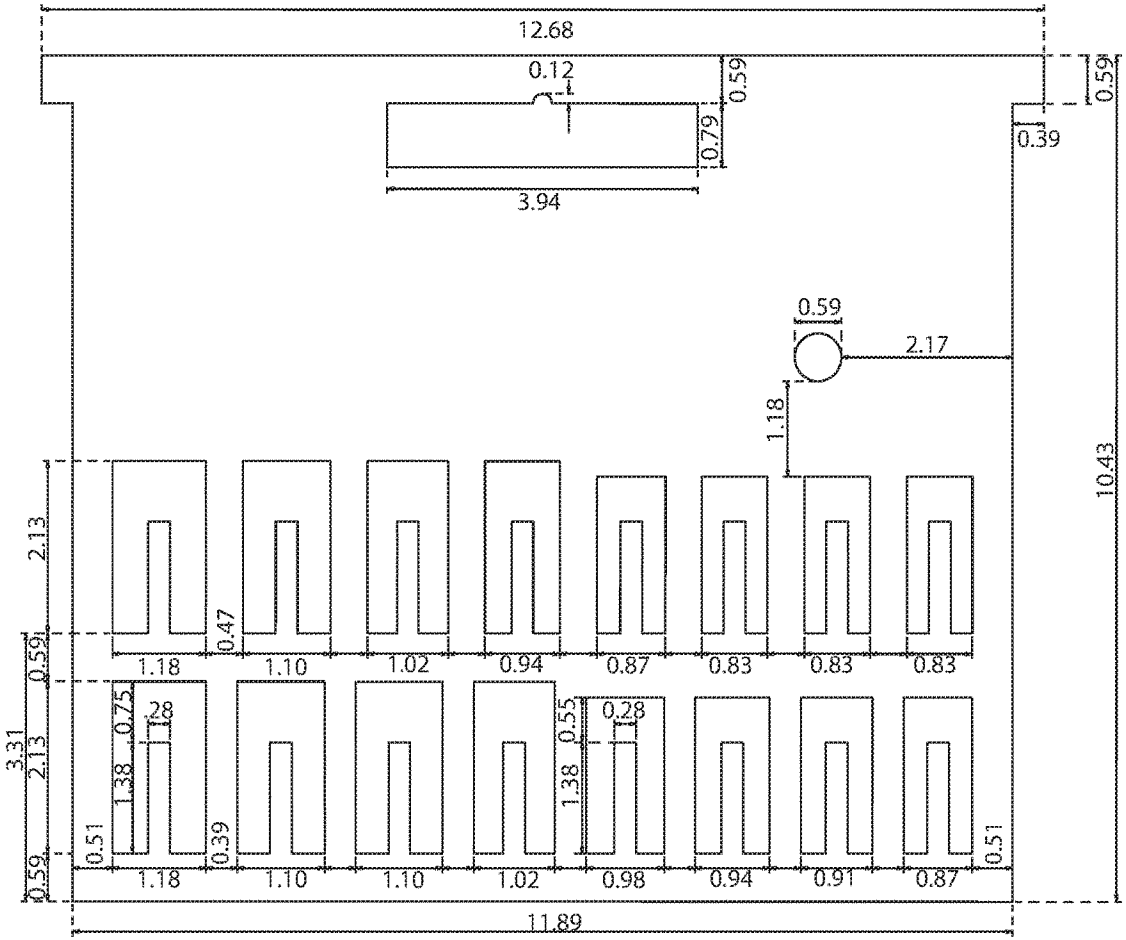
FIG. 31 is a front view of a non-limiting example of a dimensioned sheet (dimensioned in inches) for a tool holder according to principles of the invention.

FIG. 31 provides a front view of a non-limiting example of a dimensioned sheet (panel 5), dimensioned in inches, for a tool holder according to principles of the invention. The circular the circular aperture shown with a diameter of 0.59 may have a diameter of about 0.45 to 0.75 inches, and be positioned at various locations on the sheet with available space and room for two pairs of vertically arranged holes to one side of the aperture. The generally upside down U-shaped opening for the socket holders may have a width of about 0.75 to 1.5 inches and a height of about 1.5 to 2.5 inches. The cantilever vertical tab is flexible and has a tab width that is not greater than ⅕ to ⅓ of the width of the U-shaped opening. A gap between the top of the U-shaped opening and the vertical tab is at least about 0.5 to 1.0 inches. The handle aperture near the top of the panel is an opening of about 3 to 5 inches in width and 0.5 to 1.5 inches in height. The specific dimensions set forth in FIG. 31 are non-limiting examples.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A tool holder comprising:

a sheet, the sheet being generally rigid and planar and having a top edge, a bottom edge, a first side edge and an opposite second side edge;

a circular aperture formed in the sheet, the circular aperture having a diameter of about 0.45 to 0.75 inches; and a plurality of spaced apart socket holders formed in the sheet, the plurality of spaced apart socket holders being spaced apart from the circular aperture, each socket holder comprising:

a generally upside down U-shaped opening having a width of about 0.75 to 1.5 inches and a height of about 1.5 to 2.5 inches, the U-shaped opening including a top, a bottom, a first side and a second side, the first side and second side being parallel and spaced apart, the top and bottom being parallel and spaced apart;

the U-shaped opening defining a vertical tab extending upwardly from the bottom of the U-shaped opening, between the first side and second side of the U-shaped opening, to between the top and bottom of the U-shaped opening, the vertical tab being flexible and having a tab width that is not greater than ⅕ to ⅓ of the width of the U-shaped opening, and a gap between the top of the U-shaped opening and the vertical tab being at least about 0.5 to 1.0 inches.

2. The tool holder according to claim 1, the plurality of spaced apart socket holders including a first row of spaced apart socket holders, the bottom of each U-shaped opening of each socket holder in the first row of spaced apart socket holders being in vertical alignment.

3. The tool holder according to claim 2, the plurality of spaced apart socket holders including a second row of spaced apart socket holders, the bottom of each U-shaped opening of each socket holder in the second row of spaced apart socket holders being in vertical alignment and parallel to the bottom of each U-shaped opening of each socket holder in the first row of spaced apart socket holders.

4. The tool holder according to claim 3, further comprising a plurality of clamping devices, each clamping device comprising a clamp mounting base and flexible clamping arm extending from the clamp mounting base, the clamp mounting base being attachable to the sheet and the clamping arm defining a clamping space between the clamping arm and the sheet, the clamping space being configured to secure a tool against the sheet, and the clamping arm having a proximal end at the clamp mounting base and an opposite distal end.

5. The tool holder according to claim 4, the clamping base including a clamping base surface parallel to and abutting the sheet, and the clamping arm extending at an acute angle relative to the sheet.

6. The tool holder according to claim 5, each clamping device further comprising an elbow, the elbow comprising an intermediate segment extending from the distal end of the clamping arm towards the sheet.

7. The tool holder according to claim 6, the elbow further comprising a terminal segment extending from the intermediate segment away from and about parallel to the clamping arm towards the sheet.

8. The tool holder according to claim 7, the clamp mounting base including a clamp mounting pin and a clamp mounting hole, and the sheet including a pair of clamp mounting apertures for each of the plurality of clamping devices, the pair of clamp mounting apertures including a first clamp mounting aperture sized to receive the clamp mounting pin and a second clamp mounting aperture positioned to align with the clamp mounting hole while the clamp mounting pin is received in the first mounting aperture.

9. The tool holder according to claim 8, a first pair of clamp mounting apertures including a first lower clamp mounting aperture below a first upper clamp mounting aperture, a first clamp axis extending from the center of the first lower clamp mounting aperture to the center of the first upper clamp mounting aperture, a second pair of mounting apertures including a second lower clamp mounting aperture below a second upper clamp mounting aperture, a second clamp axis extending from the center of the second lower clamp mounting aperture to the center of the second upper clamp mounting aperture, the first clamp axis being parallel to and spaced apart from the second clamp axis, a third clamp axis extending from the center of the first lower clamp mounting aperture to the center of the second lower clamp mounting aperture, and a fourth clamp axis extending from the center of the first upper clamp mounting aperture to the center of the second upper clamp mounting aperture, the third clamp axis being perpendicular to the first clamp axis and parallel to the fourth clamp axis.

10. The tool holder according to claim 9, the plurality of clamping devices including a first clamping device and a second clamping device, and the tool holder further comprising a plurality of wedges including a first wedge and a second wedge, each wedge comprising a wedge base and a stopping surface, the wedge base being attachable to the sheet, and the stopping surface being about perpendicular to the wedge base, and the first wedge being attached to the sheet adjacent to the first clamping device, and the second wedge being attached to the sheet adjacent to the second clamping device.

11. The tool holder according to claim 4, further comprising a plurality of wedges, each wedge comprising a wedge base and a stopping surface, the wedge base being attachable to the sheet, and the stopping surface being about perpendicular to the wedge base.

12. The tool holder according to claim 11, the wedge base including a wedge mounting pin and a wedge mounting hole, and the sheet including a pair of wedge mounting apertures for each of the plurality of wedges, the pair of wedge mounting apertures including a first wedge mounting aperture sized to receive the wedge mounting pin and a second wedge mounting aperture positioned to align with the wedge mounting hole while the wedge mounting pin is received in the first wedge mounting aperture.

13. The tool holder according to claim 12, a first pair of wedge mounting apertures including a first left wedge mounting aperture and a first right wedge mounting aperture, a first wedge axis extending from the center of the first left wedge mounting aperture to the center of the first right wedge mounting aperture, a second pair of wedge mounting apertures including a second left wedge mounting aperture and a second right wedge mounting aperture, a second wedge axis extending from the center of the second left wedge mounting aperture to the center of the second right wedge mounting aperture, the first wedge axis being aligned with and spaced apart from the second wedge axis.

14. The tool holder according to claim 1, further comprising a handle aperture formed in the sheet adjacent to the top edge, the handle aperture comprising an opening of about 3 to 5 inches in width and 0.5 to 1.5 inches in height.

15. The tool holder according to claim 1, further comprising a pair of support tabs including a first tab extending from the first side edge of the sheet at the top edge of the sheet, and a second tab extending from the second side edge of the sheet at the top edge of the sheet.

16. The tool holder according to claim 1, further comprising a plurality of sockets, each socket of the plurality of sockets being held in one of the plurality of spaced apart socket holders, each socket comprising a generally cylindrical tool with a first end and an opposite second end, and at the first end, a recessed opening sized and shaped to fit over a hexagonal head of a fastener, and at the second end, a square cross-section recess configured to fit over the square cross-section drive of the ratchet wrench, and the vertical tab of each of the plurality of spaced apart socket holders in which each socket is held extending through the square cross-section recess.

* * * * *